United States Patent [19]

Bender

[11] Patent Number: 4,860,505

[45] Date of Patent: Aug. 29, 1989

[54] CONSTRUCTION BLOCK

[76] Inventor: David C. Bender, 39 Manitou Drive, Kitchener, Ontario, Canada

[21] Appl. No.: 198,839

[22] Filed: May 26, 1988

[51] Int. Cl.[4] ..... E04C 1/10

[52] U.S. Cl. ..... 52/98; 52/593; 52/596; 52/605; 405/286; 47/83

[58] Field of Search ..... 52/596, 603, 604, 605, 52/98, 125.3, 593; 405/284, 285, 286, 287; 47/83

[56] References Cited

U.S. PATENT DOCUMENTS

| | | | |
|---|---|---|---|
| 4,490,075 | 12/1984 | Risi et al. | 405/286 X |
| 4,524,551 | 6/1985 | Scheiwiller | 52/605 X |
| 4,671,706 | 6/1987 | Giardini | 52/593 X |

FOREIGN PATENT DOCUMENTS

| | | | |
|---|---|---|---|
| 14561 | 2/1882 | Canada . | |
| 84612 | 6/1904 | Canada . | |
| 155595 | 1/1914 | Canada . | |
| 290131 | 6/1929 | Canada . | |
| 290144 | 6/1929 | Canada . | |
| 365565 | 4/1937 | Canada . | |
| 1188116 | 6/1985 | Canada . | |
| 1225246 | 8/1987 | Canada . | |
| 957860 | 5/1949 | France | 52/605 |
| 548936 | 10/1956 | Italy | 52/605 |

OTHER PUBLICATIONS

Figs. 1–4 of Canada 273,942.
Figs. 1–20 of Canada 1,078,183.
Figs. 1–11 of Canada 736,680.
Figs. 1–20 of Canada 312,460.

*Primary Examiner*—Henry E. Raduazo
*Assistant Examiner*—Jerrold D. Johnson
*Attorney, Agent, or Firm*—Wenderoth, Lind & Ponack

[57] ABSTRACT

A construction block adapted to interact with other like blocks comprises a body substantially in the shape of a rectangular parallelepiped having a front face, a rear face, a top face, a bottom face and a pair of side faces. The bottom face has a plurality of substantially identical grooves formed therein, parallel with the front face, and extending across the bottom face from one side face to the other. These grooves are of generally constant cross-section and are spaced apart evenly between the front face and the rear face of the block. The top face of the block is provided with at least two ridges thereacross, parallel with the grooves, and each receivable within a groove of a like construction block. There are fewer ridges than grooves, and the outermost of the ridges are spaced from the front and rear faces of the block at least the distance between said faces and the second closest groove.

10 Claims, 2 Drawing Sheets

CONSTRUCTION BLOCK

BACKGROUND OF THE INVENTION

This invention relates to wall construction, and, more particularly to a unique block useful in such construction. While the construction blocks of this invention are particularly useful for building retaining walls and the like, the blocks can in fact be used for conventional wall constructions with the use of suitable mortars of cementitious materials.

There are a variety of interlocking or interacting blocks currently available for use in the construction of retaining walls and the like. Such blocks are usually designed so that a number of courses composed of similarly shaped blocks may be arranged one on top of the other in such a way that the blocks of one course interlock or interact with blocks of the adjacent courses to produce a wall which exhibits a relatively high degree of resistance to horizontal shear forces. However, such blocks are usually so formed that, when the courses are arranged one atop the other in such a manner that the blocks of one course interlock or interact with the blocks of the adjacent courses, the resulting wall will be either vertical, or have a predetermined angular inclination from the vertical. Further, such blocks are usually useable in only one orientation with the result that, for example, if a retaining wall is being constructed, the blocks must always have one face directed outwardly to form a visible wall surface, and the opposite face directed inwardly against the earth or material being retained. It will be apparent that such blocks permit relatively little flexibility in wall construction, in that a given construction block may be used only to produce a wall having either a vertical face or a face which exhibits a fixed deviation from the vertical, and a wall whose visible surface will have a predetermined texture or appearance.

It is therefore an object of this invention to provide a construction block of relatively simple form which may be used with other like blocks to produce a wall in which each course of blocks interlocks or interacts with an adjacent course to resist horizontal shear and which can be so arranged to present a vertical wall face, or a face which deviates from the vertical in varying degrees, or combinations thereof.

It is a further object of the invention to provide such construction blocks that can be used in reverse orientation so that if used in one orientation a wall surface may exhibit one surface texture or appearance, but if used in the reverse orientation, the wall surface may exhibit a different surface texture or appearance.

SUMMARY OF THE INVENTION

The foregoing objects are achieved through use of a construction block adapted to interact with other like construction blocks comprising a body substantially in the shape of a rectangular parallelepiped having a front face, a rear face, a top face, a bottom face and a pair of side faces. The bottom face is provided with a plurality of substantially identical parallel transverse grooves extending from one side face to the other, these grooves being of constant cross-section and being spaced apart evenly between the front and the rear face. The top face of The block is provided with at least two ridges, each being parallel with, and in vertical alignment with one of the grooves, and receivable within a groove f a like construction block. There are fewer ridges than grooves, and the outermost of the ridges is set back from the front and rear faces at least the distance between said faces and the second closest groove.

Preferably the ridges are disposed symmetrically with respect to the transverse cross-sectional plane of the block, and preferably the front face of the block will exhibit a different surface characteristic from the rear face of the block.

DESCRIPTION OF THE PREFERRED EMBODIMENT

Figure 1:
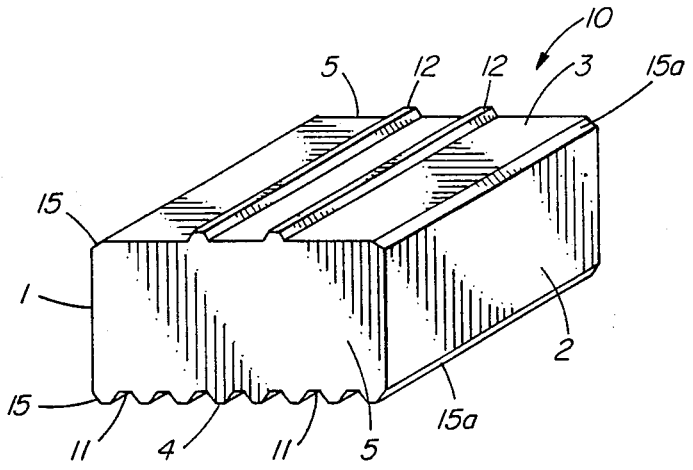
FIG. 1 is a pictorial view of a single construction block in accordance with the invention.

A typical single block 10, in accordance with the invention, is depicted in FIG. 1. The block consists of a front face 1, a rear face 2, a top face 3, a bottom face 4, and a pair of side faces 5. The bottom face is provided with a plurality of parallel transverse grooves 11 of trapezoidal cross-section and, in the embodiment illustrated, the top face is provided with a pair of transverse parallel ridges 12, also of trapezoidal cross-section, the ridges being disposed symmetrically with respect to the transverse cross-sectional center plane of the block, with each ridge being in alignment with one of the grooves on the bottom face.

In the illustrated embodiment, there are seven grooves and two ridges with each ridge being in alignment with the groove on either side of the centrally located groove. It would of course be possible to include a further ridge in alignment with the centrally located groove, although it has been found that two ridges are sufficient to resist transverse sheer forces usually encountered in practice. It would also be possible for two ridges of the type illustrated to be in alignment with the second groove from the center (or alternately the second groove from the respective face 1 or 2). However, for reasons which will hereafter be explained, it is desirable that the ridges, or at least the outermost ridges be spaced inwardly from the front and rear faces 1 and 2 at least a distance equal to the distance between these faces and the second closest groove.

Preferably the ridges will correspond in cross-sectional shape to the cross-sectional shape of the grooves, although it is important that the cross-sectional dimensions of the ridges be slightly less than the cross-sectional dimensions of the grooves so that the ridges will fit easily within the grooves of a like construction block. The tolerances will be largely a matter of choice. The looser the fit; the more readily it is possible to create a wall having a degree of curvature in the horizontal plane.

Figure 2:
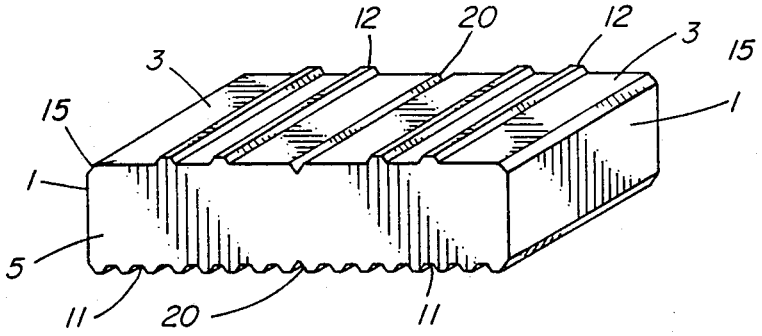
FIG. 2 is a pictorial view of a dual construction block in accordance with the invention.
Figure 3:
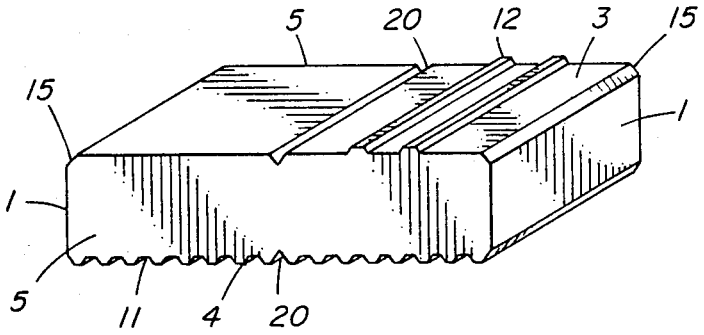
FIG. 3 is a pictorial view of a different embodiment of a dual construction block in accordance with the invention.
Figure 4:
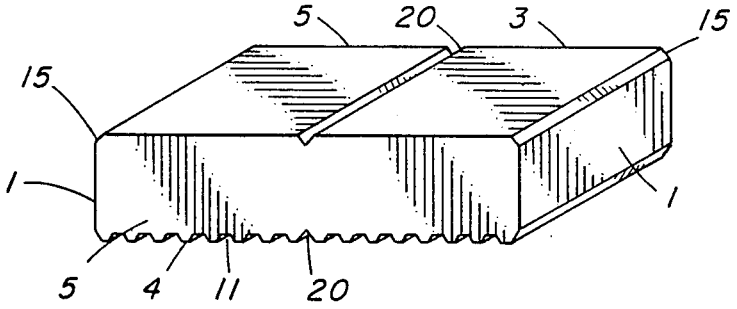
FIG. 4 is a further embodiment of a dual construction block.

The blocks in question will usually be molded or cast concrete, and, while it is possible to produce single blocks such as that depicted in FIG. 1 in this manner, it is more convenient to produce dual blocks such as those depicted in FIGS. 2, 3 and 4. The dual block of FIG. 2 corresponds to two single blocks such as that depicted in FIG. 1. It is provided with a pair of vertically aligned V-shaped splitting grooves 20 in its upper and lower face which facilitates splitting of the dual block along its transverse cross-sectional center plane to produce a pair of mirror-image blocks as illustrated in FIG. 1. It will be apparent that the dual block may be cast so that the front faces 1 of the individual blocks will exhibit a smooth texture, whereas the rear faces 2 of the individual blocks 1, which faces are produced by splitting the dual block through splitting grooves 20, will exhibit a rough irregular texture reminiscent of natural stone. In this way, in a very simple manner, single construction blocks may be produced which are substantially uniform and symmetrical, but which have one surface texture on the front face and quite a different surface texture on the rear face.

FIG. 3 illustrates a dual block which is similar to that depicted in FIG. 2, but which has ridges only on the upper face of the righthand side, and FIG. 4 illustrates a similar dual block without any ridges whatsoever on its upper face. The blocks without ridges on their upper surfaces are used as coping blocks to form the top of a wall, so that the top will exhibit a smooth, even surface. The coping blocks can be produced exclusively as depicted in FIG. 4, or they may be produced in combination with the standard single construction block as illustrated in FIG. 3. In either case, the coping blocks will, like the regular blocks, exhibit a smooth front face and an irregular rear face resembling natural cut stone when split through V-shaped grooves 20.

In the illustrated embodiments, the front faces of the blocks exhibit chamferred top and bottom edges as at 15. These are produced automatically on the corresponding rear faces 2 by the splitting groove 20, as illustrated at 15*a* in FIG. 1.

It is not necessary that the dual blocks be split to form two standard single blocks 10. It may very well be desirable, when constructing a wall, to produce an initial base course consisting of dual blocks, and, depending upon the height of the desired wall, it may be desirable to utilize several courses of dual blocks in the base courses, and to utilize several upper courses of single blocks to produce the upper top portion of the wall. The arrangement will usually depend upon the height of the wall being constructed.

Figure 5:
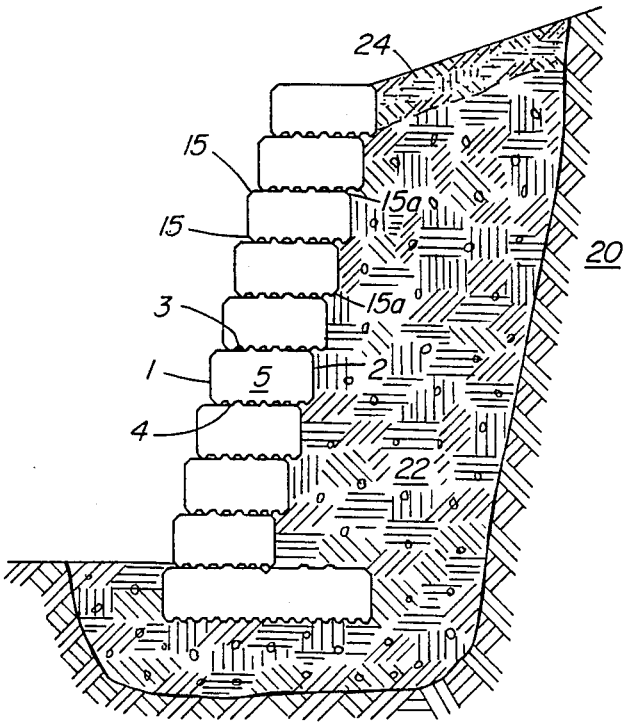
FIG. 5 is a side view, partially in section, showing a form of retaining wall construction utilizing single and dual construction blocks in accordance with the invention.

A simple form of retaining wall construction is depicted in FIG. 5 and consists of a first or base course of dual blocks, with subsequent courses of single blocks 10. In the embodiment illustrated the front face 1 of each succeeding course of blocks is spaced inwardly a distance of one complete groove to produce an outer or visible wall surface which deviates about 14° from the vertical. It will be understood that, by shifting the blocks to the left, a distance of one groove, the front faces 1 of each block would be in precise vertical alignment, and a wall having a vertical outer face would result. Conversely, by shifting the block of each successive course to the right one groove, a wall having a considerably greater deviation to the vertical would be produced. The reason for spacing the outermost ridge inwardly from the front and rear faces a distance greater than the outermost groove, is to permit a sloping wall to be produced without any ridges being visible at the outer, or visible surface.

It would obviously be possible to produce two or three courses with the slope as illustrated in FIG. 5, with the next two or three courses being in precise vertical alignment, and the following two or three courses with a slope approximately double that of the first two or three courses. Various combinations of front face slope can be produced with the same blocks simply by shifting various courses to the left or the right while preserving the interlocking or interacting characteristics of the adjacent courses.

In FIG. 5, the original soil is designated 20 and compacted crushed granular backfill is designated 22. In constructing a retaining wall of this type, normally the base is dug below grade and filled with compacted crushed granular material to form a solid seat for the base, which in this case is formed by a course of the dual blocks depicted in FIG. 2. Thereafter, as the various courses of the wall are set one upon the other, crushed granular backfill is inserted between the rear face of the wall and the original soil, and is compacted. At the top of the wall, coping blocks such as those depicted in FIGS. 3 and 4 are employed which have a smooth, ridge-free upper face, and top soil 24 is added on top of the fill between the top of the retaining wall and the original soil at a desired slope.

While FIG. 5 illustrates a wall in which the front or visible face is formed by the smooth textured front faces 1 of the individual blocks 10, it will be apparent that, simply by reversing the orientation of the blocks, the identical wall could be produced with the rough textured surfaces 2 forming the front or visible wall surface. Additionally, because the blocks are symmetrical, it is possible to produce designs where, for example, the courses of the wall alternate between smooth and rough textured surfaces, and it is also possible to alternate the blocks within individual courses. Indeed, for some decorative effects, it may be desirable to produce a rough or rocky appearance by so positioning individual blocks in a course, and in different courses, so that their forward facing surfaces project outwardly, or are recessed inwardly with respect to the general pattern of the remaining blocks. All of these variations are possible because the plurality of grooves on the bottom face of each block facilitates inward or outward adjustment of each block individually with respect to the blocks immediately above or below, or to either side of it. The interlocking or interacting characteristics of the wall construction are preserved and no loss of integrity results. The engagement of the ridges with the grooves in adjacent courses resists horizontal shear forces arising from the pressure of the soil being retained, while permitting a great deal of flexibility insofar as the slope of the outer wall face is concerned, and also insofar as the surface texture and appearance of the outer wall face is concerned.

While use of the construction blocks in a conventional retaining wall is illustrated, it is also possible to utilize the same blocks in a similar manner in conventional vertical wall construction of heights far greater than would normally be used for retaining walls simply by utilizing a conventional mortar or cementitious composition between the various courses. If this is done, it would normally be desirable to produce the blocks with ridges which fit rather loosely in the grooves to accommodate the mortar or cementitious material.

While the construction blocks illustrated herein may be produced in various sizes, a typical single block 10 will have a width from side to side of about 300 millimeters, a depth from front face to rear face of about 200 millimeters and grooves of a depth of about 10 millimeters. Generally the chamfers 15 and 15*a* will be similar in depth to the depth of the grooves.

While the particular construction blocks shown and described in detail herein are fully capable of attaining the objects and providing the advantages described herein, it is to be understood that they are merely illustrative of the presently preferred embodiment of the invention. No limitations are intended in the details of the construction, design or materials shown, other than as defined in the attached claims, which form a part of this disclosure.

What I claim as my invention is:

1. A construction block for interacting with other like blocks comprising:

a body substantially in the shape of a rectangular parallelepiped having a front face, a rear face, a top face, a bottom face and a pair of side faces;

a plurality of substantially identical parallel transverse grooves only in said bottom face and extending thereacross from one side face to the other;

said grooves being of constant cross-section and being spaced apart evenly between the front face and the rear face; and at least two substantially identical ridges only on said top face, each said ridge being parallel with and in vertical alignment with one of said grooves, and receivable within a groove of a like block, there being fewer ridges than grooves, and the outermost of said ridges being set back from said front and rear faces at least a distance equal to that between said faces and the second closest groove.

2. A construction block according to claim 1 wherein said ridges are disposed symmetrically with respect to a parallel central transverse cross-sectional plane of said block.

3. A construction block according to claim 2 wherein said front face and said rear face have different surface characteristics.

4. A construction block according to claim 3 in which the upper and lower edges of the front and rear faces are chamferred.

5. A construction block according to claim 3 in which the grooves and ridges are of trapezoidal cross-section, with the cross-sectional shape of the ridges corresponding to the cross-sectional shape of the grooves, and the ridges being so dimensioned as to be loosely receivable within said grooves.

6. A construction block in accordance with claim 5 wherein there are seven grooves and two ridges and said ridges are aligned with the grooves on either side of the middle groove.

7. A dual construction block comprising a body substantially in the shape of a rectangular parallelepiped having a pair of end faces, a top face, a bottom face and a pair of side faces;

vertically aligned transverse splitting grooves in said top and bottom faces midway between said end faces to define a pair of mirror image single blocks connected at their rear faces with said end faces defining front faces;

a plurality of substantially identical parallel transverse grooves only in the bottom face of each single block, and extending thereacross from one side face to the other;

said grooves being of constant cross-section and being spaced apart evenly between the front face and the rear face; and at least two ridges only on the top face of each single block, each said ridge being parallel with and in vertical alignment with one of said grooves, and receivable within a groove of a like single block, there being fewer ridges than grooves, and the outermost of said ridges being set back from the front and rear faces at least a distance equal to that between the front and rear faces and a respective second closest groove.

8. A dual construction block according to claim 7 wherein said ridges are disposed symmetrically with respect to a parallel central transverse cross-sectional plane of each single block.

9. A dual construction block according to claim 8 in which the grooves and ridges are of trapezoidal cross-section, with the cross-sectional shape of the ridges corresponding to the cross-sectional shape of the grooves, and the ridges being so dimensioned as to be loosely receivable within said grooves.

10. A dual construction block in accordance with claim 9 wherein each single block has seven grooves and two ridges with said ridges being aligned with the grooves on either side of the middle groove.

* * * * *